US005893323A

United States Patent [19]

Ishii et al.

[11] Patent Number: 5,893,323

[45] Date of Patent: Apr. 13, 1999

[54] PRINTING DRUM SUPPORTING DEVICE FOR STENCIL PRINTING MACHINE

[75] Inventors: Shigenori Ishii; Katsuro Motoe; Koji Nakayama, all of Ibaraki-ken, Japan

[73] Assignee: Riso Kagaku Corporation, Tokyo, Japan

[21] Appl. No.: 09/097,917

[22] Filed: Jun. 16, 1998

[30] Foreign Application Priority Data

Jul. 1, 1997 [JP] Japan ..... 9-175876

[51] Int. Cl.[6] ..... B41L 13/04

[52] U.S. Cl. ..... 101/116; 101/216

[58] Field of Search ..... 101/116, 216, 101/483

[56] References Cited

U.S. PATENT DOCUMENTS 5,553,537 9/1996 Hara ..... 101/116

5,609,101 3/1997 Oyama et al. ..... 101/116

*Primary Examiner*—Edgar Burr

*Assistant Examiner*—Leslie Grohosky

*Attorney, Agent, or Firm*—Kanesaka & Takeuchi

[57] ABSTRACT

A printing drum supporting device for a stencil printing machine comprises a forward side-plate and a rear side-plate disposed at a certain distance therebetween, a frame for supporting the drum, a rail device disposed between the two side-plates for guiding the frame, and a pipe disposed between the two side-plates. The frame includes a forward plate and a rear plate disposed at a certain distance therebetween. The rear plate has a hole. The frame supports a rotatable cylindrical printing drum between the forward plate and the rear plate. The frame is detachably supported by the rail device. The frame can slide along the rail device between a printing position inside the two side-plates and a disengagement position outside the same. The pipe is fixed between the two side-plates. An end portion of the pipe is protruding outside through the rear side-plate. An axis of the hole of the rear plate is located vertically beneath an axis of the pipe at a small distance when the frame with the drum is pulled out to the disengagement position. When the frame with the drum is guided to the printing position, the end portion of the pipe is fitted into the hole of the rear plate and the rear plate of the frame is raised small vertically. Thus a frame load of the rear plate side is carried by the rear plate and the pipe.

3 Claims, 7 Drawing Sheets

PRINTING DRUM SUPPORTING DEVICE FOR STENCIL PRINTING MACHINE

BACKGROUND OF THE INVENTION

The present invention concerns a structural improvement in supporting a detachable printing drum in a stencil printing machine.

Referring to FIG. 7, a general explanation will be made to a structure for supporting and guiding a detachable printing drum in a conventional stencil printing machine. The stencil printing machine is composed of functional units for such as perforating, printing, paper feeding, paper discharging, stencil discharging, image reading, and so on. Specifically, a perforating unit perforates a stencil sheet; a printing drum of a printing unit conducts printing with a perforated stencil sheet wrapped on the outer circumferential surface thereof. And a paper feeding unit provides paper with the printing drum; a paper discharge unit receives a printed paper. Further, a stencil discharge unit removes and discards a used stencil sheet from the printing drum. And an image reading unit reads an image from an original for perforation.

FIG. 7 illustrates the printing unit of the conventional stencil printing machine, specifically a structure for supporting and guiding the printing drum in the printing unit. In the drawing, reference numeral 2 indicates a forward side-plate; also reference numeral 4 indicates a rear side-plate. Reference numeral 6 indicates the printing drum, around which a perforated stencil sheet is wrapped, of the stencil printing machine. An ink supplying device is disposed inside the printing drum. An ink supplied by the ink supplying device is to be transferred to a printing paper through the printing drum and perforations formed in the stencil sheet.

Reference numeral 8 indicates a forward plate (a forward member); also reference number 10 indicates a rear plate (a rear member). Both the plates are connected with plural arms 12 to form a frame 13. In the frame 13, the printing drum 6 is rotatably supported around its axis between both the plates 8,10.

Reference numerals 14 and 16 indicate rail devices (sliding rails). Fixed rails 14*a*, 16*a* are supported horizontally between the two side-plates so as to be parallel to each other. In the rail devices, sliding rails 14*b*, 16*b* are respectively attached to the fixed rails 14*a*, 16*a*. The sliding rails 14*b*, 16*b* can move parallel with the fixed rails 14*a*, 16*a*. The sliding rails 14*b*, 16*b* can carry the frame 13. If the sliding rails 14*b*, 16*b* carrying the frame 13 move parallel with the fixed rails 14*a*, 16*a*, the printing drum 6 attached to the frame 13 moves between a printing position and a disengagement position. The printing position is inside the forward side-plate and the rear side-plate; and the disengagement position is outside the same (outside the machine).

A hook (not shown in the drawing) is disposed on the inner side of the sliding rails 14*b*, 16*b* for holding the arm 12 of the frame 13. By engaging the hook with the arm 12, the frame 13 is mounted on the sliding rails 14*b*, 16*b*. When the hook is engaged with the arm, the frame 13 can not move in the drum axial direction relative to the sliding rails 14*b*, 16*b*.

A supporting axis 20 for the printing drum 6 is extending through and protruding forward the forward plate 8. For convenience in illustration, the supporting axis 20 is drawn in imaginary line in FIG. 7. The printing drum 6 is rotatably supported on the frame 13 via the supporting axis 20. Further, a protruding portion 22 of a tube shape is fixed to a part of the forward plate 8, and the protruding portion 22 is parallel with the supporting axis 20. Holes 2*a*, 2*b* are formed in the forward side-plate 2. When the printing drum 6 is guided along the rail devices 14, 16 toward the printing position inside the machine, the supporting axis 20 is fitted into the hole 2*a* and the protruding portion 22 is fitted into the hole 2*b*. The protruding portion 22 is for detecting whether the printing drum 6 is in the position inside the machine; a detecting means is equipped with the outside of the forward side-plate 2, although it is not shown.

In the rear side-plate 4, there is formed a hole 4*a* through which the printing drum 6 is received into the inside of the machine. Two frame support members 18, 18 are disposed to the rear side-plate 4 to be respectively adjacent to the rail devices 14, 16. The frame support member 18 is in an approximate rectangular parallelopiped shape, and is fixed to the rear side-plate 4 with screws. The two frame support members 18, 18 have a protruding rib 18*a* respectively, which are formed on the inner sides thereof facing with each other. Further, engaging portions 11, 11 are integrally formed on the both sides of the rear plate 10. Each engaging portion 11 has a groove 11*a* formed in approximate U-shape.

By moving the frame 13 along the rail devices 14, 16 from the disengagement position outside the machine to the printing position inside the machine, each protruding rib 18*a* engages each groove 11*a*. As a result of the engagement, the frame support members 18 support the rear side of the frame 13 that carries the printing drum 6. Further, the forward side of the printing drum 6 is supported by engaging the supporting axis 20 with the hole 2*a*.

According to the conventional printing drum supporting device thus explained, the rear side (nearer side in FIG. 7) of the movable printing drum tends to be shaky, and printing matter obtained blurs in density in traverse direction thereof, which direction is parallel with the axial direction of the drum during stencil printing.

The object of the present invention is to provide a printing drum supporting device for a stencil printing machine, which is capable of overcoming the foregoing problems thus explained.

SUMMARY OF THE INVENTION

A printing drum supporting device as defined in the first aspect of the present invention is adapted to be equipped with a stencil printing machine. The device comprises a forward side-plate and a rear side-plate disposed at a predetermined distance therebetween and a frame including a forward member and a rear member disposed at a predetermined distance therebetween. The rear member has a hole. The frame supports the cylindrical printing drum to be rotatable around a center axis thereof between the forward member and the rear member. The device also comprises a rail member disposed between the forward side-plate and the rear side-plate. The rail member supports the frame to be detachable and also guides the frame to be movable in an axial direction of the drum between a printing position and a disengagement position; the printing position is between the forward and rear side-plates and the disengagement position is outside those plates. Further, the device comprises a longitudinal member fixed between the forward side-plate and the rear side-plate. An end portion of the longitudinal member protrudes outside through the rear side-plate. Owing to the constitution thus explained, the end portion of the longitudinal member is fitted into the hole of the rear member when the frame supporting the cylindrical printing drum is guided to the printing position.

In the printing drum supporting device defined in the second aspect of the present invention, a tapered receiving portion is formed in a front opening of the hole of the rear member in the first aspect.

In the printing drum supporting device defined in the third aspect of the present invention, an axis of the hole of the rear member is located vertically beneath an axis of the longitudinal member at a small distance when the frame supporting the cylindrical printing drum is pulled out to the disengagement position, the rear member of the frame is raised vertically in a small distance when the longitudinal member is fitted into the hole so that a load of the frame of the rear member side is carried by the rear member and the longitudinal member in the second aspect.

DETAILED DESCRIPTION OF PREFERRED EMBODIMENTS

Figure 1:
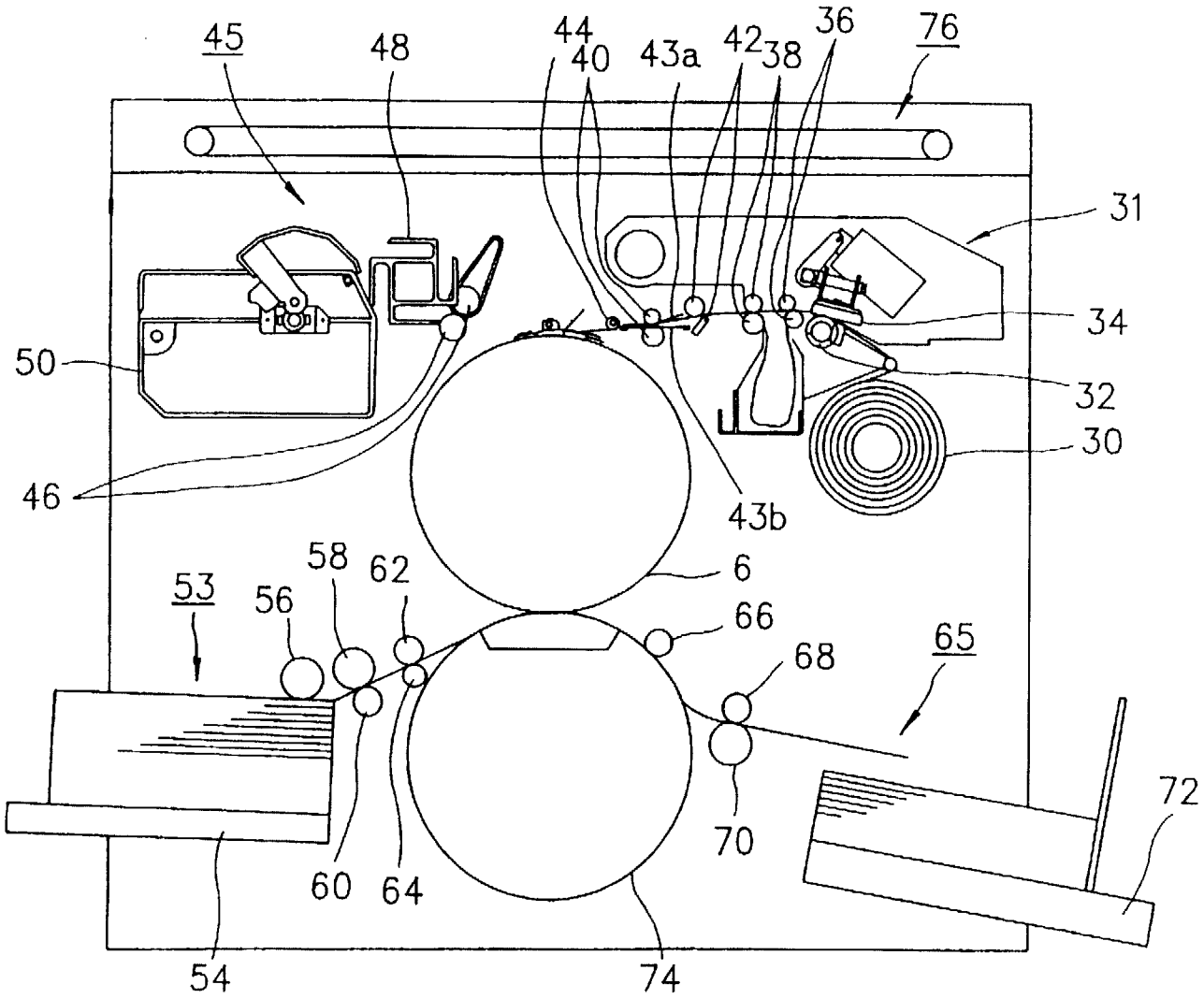
FIG. 1 is a schematic whole diagram of a stencil printing machine of one embodiment according to the present invention.

Referring to FIG. 1, one embodiment of the present invention will be explained.

FIG. 1 illustrates a structure of a stencil printing machine in the present embodiment. In the drawing, reference numeral 31 indicates a perforating unit, reference numeral 45 indicates a stencil discharge unit, reference numeral 53 indicates a paper feeding unit, reference numeral 65 indicates a paper discharge unit, and reference numeral 76 indicates an image reading unit.

An explanation will be made to the perforating unit 31. A cylindrically rolled stencil sheet 30 is transferred to a cylindrical printing drum 6 (hereinafter call a printing drum 6) side with conveying rollers 36, 38, and 40 after being perforated by means of platen roller 32 and a thermal head 34. The stencil sheet, after being clamped by the leading end, is wrapped around the printing drum 6 by driving the drum 6 in a counterclockwise direction. Reference numeral 42 indicates a cutter for cutting the stencil sheet in a length adequate for one perforating operation. Reference numerals 43*a*, 43*b* indicate upper and lower guiding plates for guiding the stencil sheet. Reference numeral 44 indicates an anti-wrinkle shaft.

An explanation will be made to the stencil discharge unit 45. There is disposed a stencil discharge roller 46 for sending the used stencil sheet which is wrapped around the printing drum 6 to a receiving section of a swastika-formed rotary member 48. The stencil sheet stored in the rotary member 48 is transferred to a discharge package 50.

An explanation will be made to the paper feeding unit 53. Upper ones of printing paper stacked on a feeding tray 54 are taken by a scraper 56 and separated from each other between a separation roller 60 and a pick-up roller 58, and then sent between a guide roller 62 and a timing roller 64 one by one. After that, the printing paper is transferred to a gap between the printing drum 6 and a press roller 74. The press roller 74 comprises a paper clamp device (not shown). The paper is transferred to a gap between the printing drum 6 and the press roller 74 as being clamped by one end with the clamp device of the press roller 74.

An explanation will be made to the paper discharge unit 65. After being printed between the printing drum 6 and the press roller 74, the printing paper is discharged onto a paper discharge tray 72 via discharge pinch rollers 66, 68 and paper discharge guide roller 70.

In the image reading unit 76, a photoelectric transfer device (not shown) scans an original, thereby converting an image of the original into electrical information, and then transmitting it to the perforating unit 31.

A portion of a circumferential wall of the printing drum 6 is an ink permeable region. An ink supplying means (not shown) is disposed in the printing drum. The printing drum is rotatable around a central axis of its own. The circumferential wall of the printing drum 6 is flexible. When the circumferential wall is pressed against the outer circumferential surface of the press roller 74 by deforming the wall outwardly, printing is conducted on the paper supplied between the drum 6 and the press roller 74.

Figure 2:
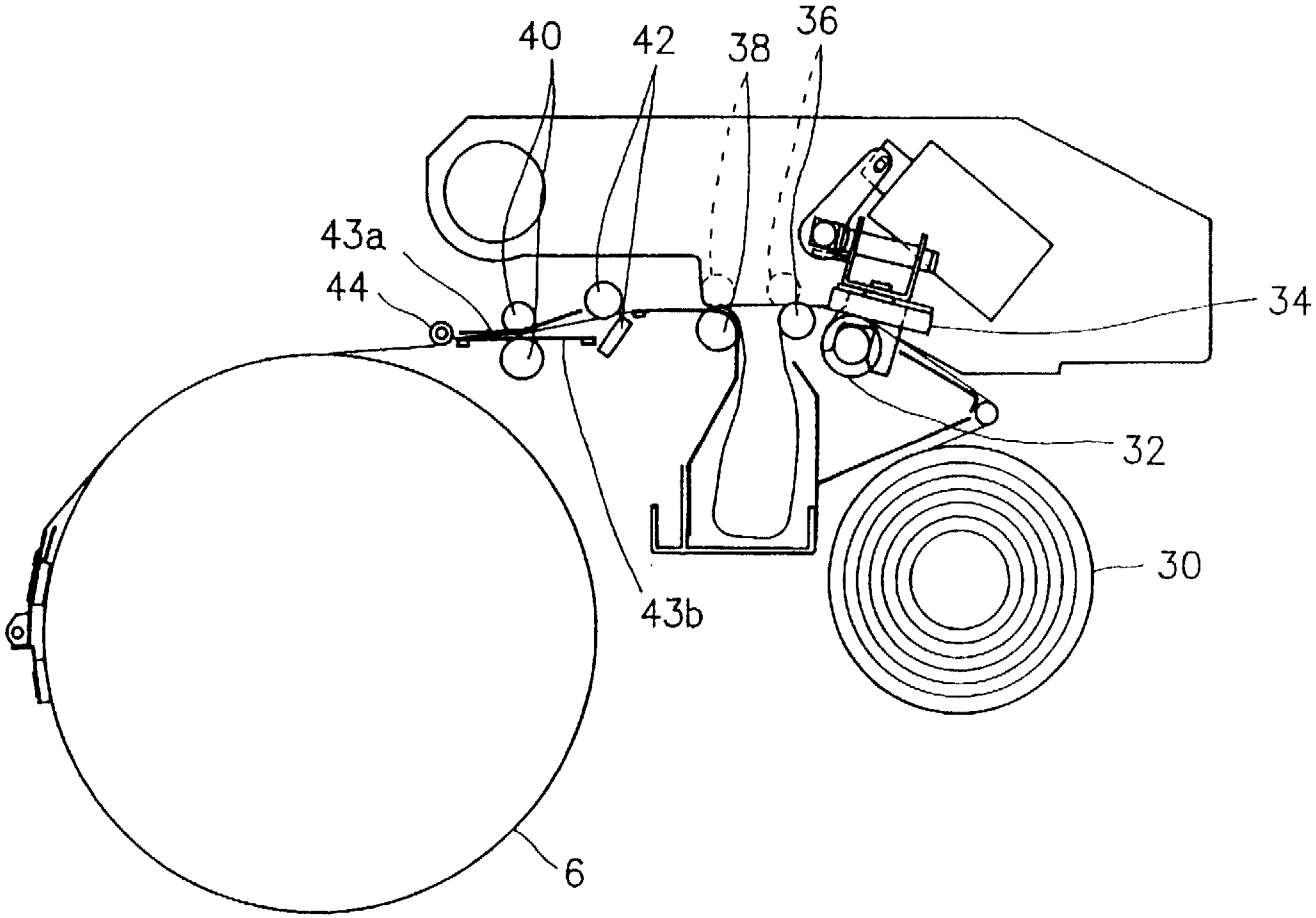
FIG. 2 is an enlarged view of a perforating unit and a printing drum in the stencil printing machine shown in FIG. 1.

FIG. 2 is an enlarged view of the perforating unit and the printing drum in the stencil printing machine illustrated in FIG. 1. The anti-wrinkle shaft 44 is cylindrical. The shaft 44 is fixed to a frame of the stencil printing machine in such a manner that a small part of the outer surface of its own is located beneath a plane extending between the leading end of the lower guiding plate 43*b* and the top of the drum.

Consequently, while the stencil sheet is wrapped around the drum 6, the lower of the anti-wrinkle shaft 44 is in contact with the upper of the stencil sheet as illustrated in FIG. 2. As a result, a predetermined tension acts on the stencil sheet, thereby preventing the stencil sheet from wrinkling.

Figure 3:
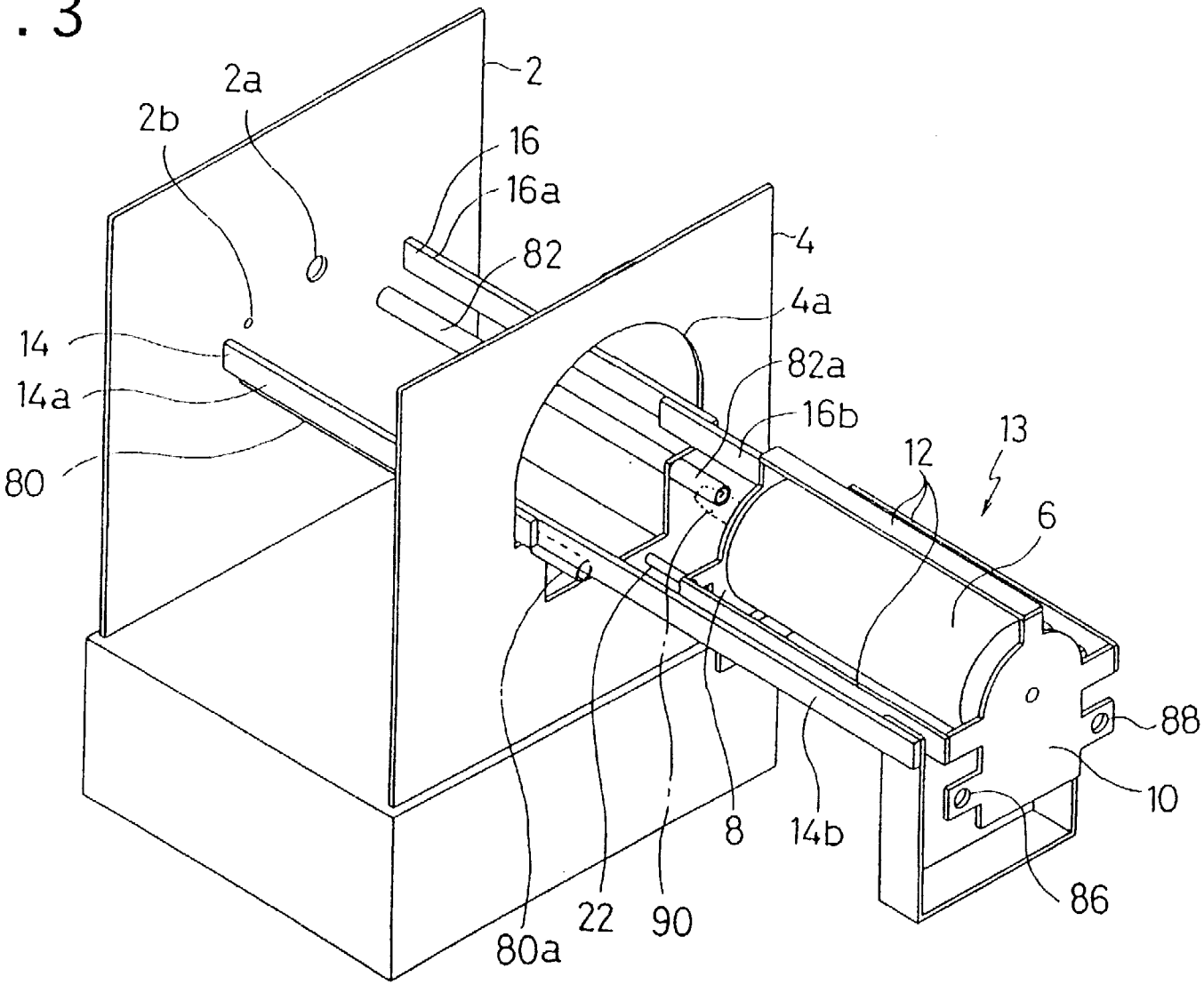
FIG. 3 is a perspective view of a printing drum supporting device (in a disengagement position) in one embodiment according to the present invention.
Figure 4:
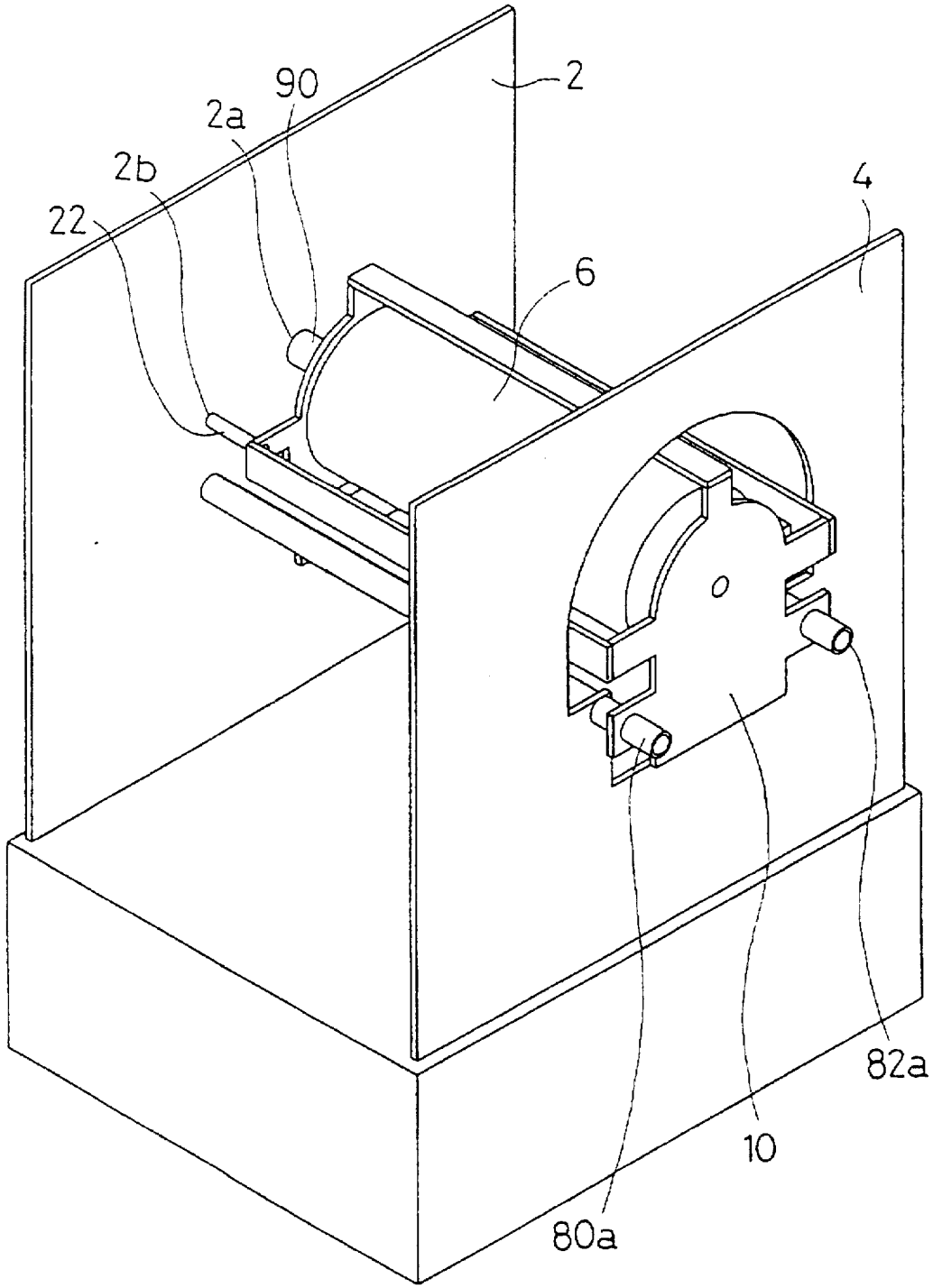
FIG. 4 is a perspective view of a printing drum supporting device (in an installment position) in one embodiment according to the present invention.
Figure 5:
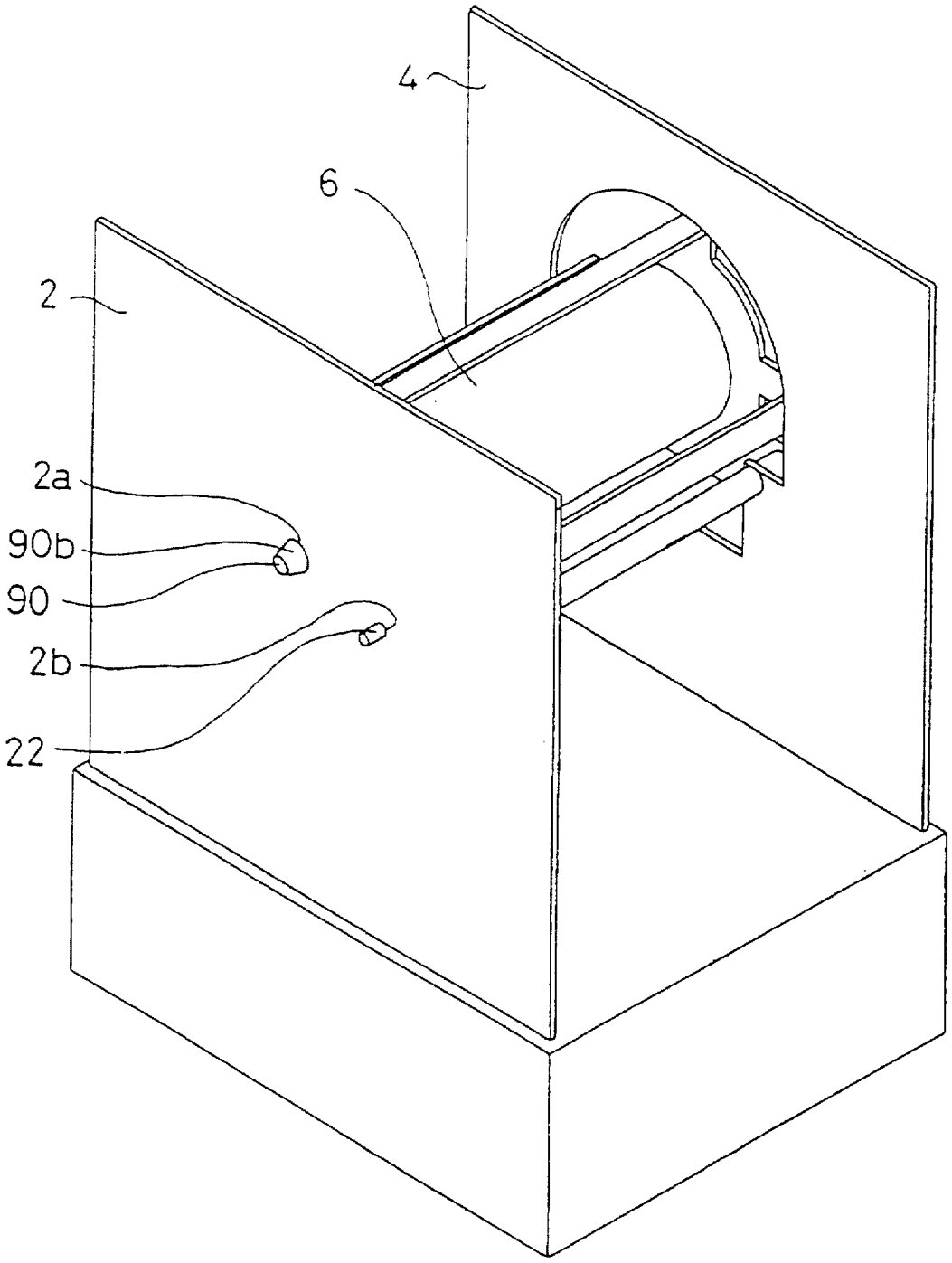
FIG. 5 is a perspective view of a printing drum supporting device (in an installment position), seen from other side of a forward side-plate, in one embodiment according to the present invention.
Figure 7:
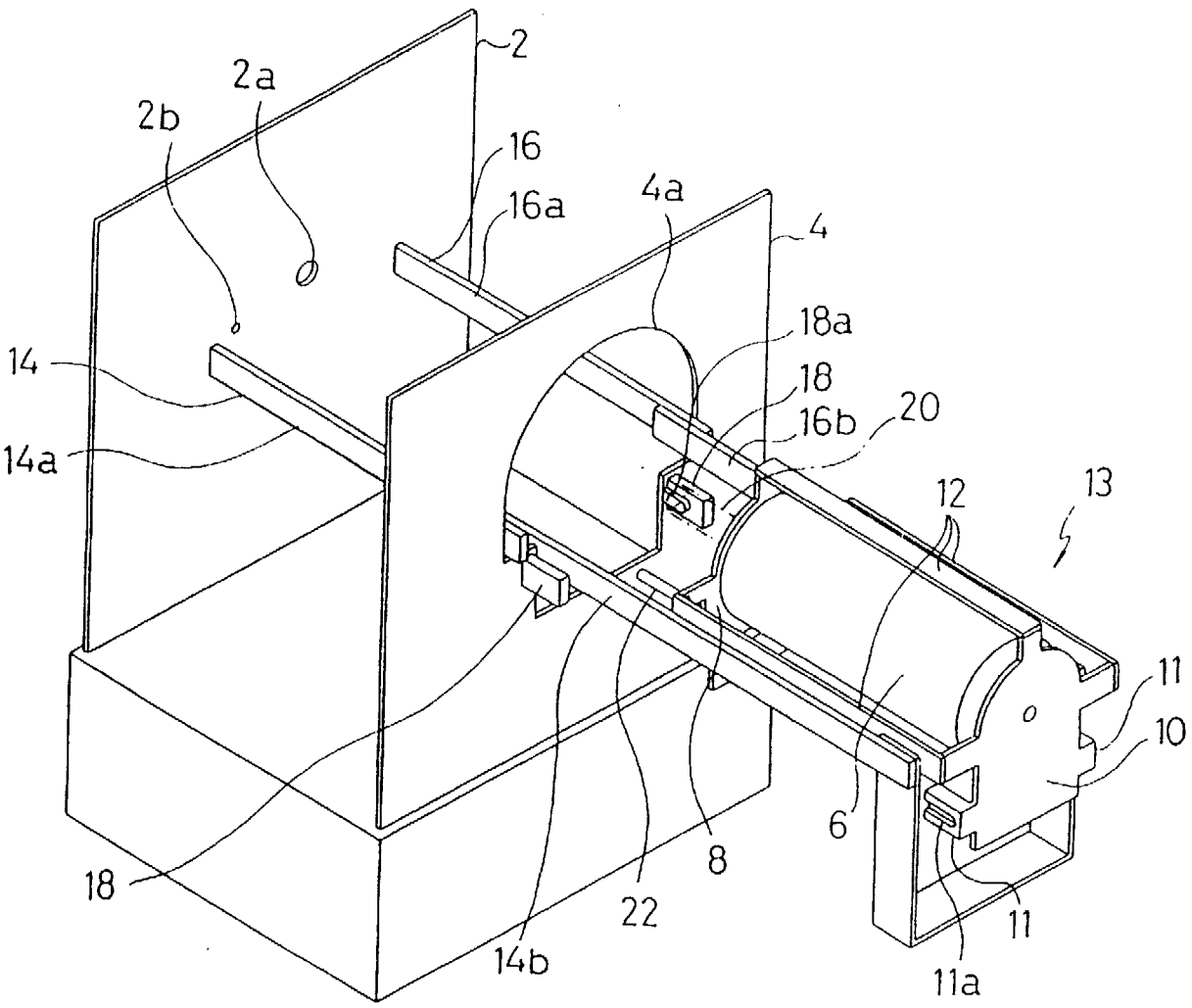
FIG. 7 Prior Art
FIG. 7 is a perspective view of a conventional printing drum supporting device.

FIGS. 3–5 is a perspective view of a printing drum supporting device in one embodiment. FIG. 3 illustrates a situation where the printing drum is drawn. FIG. 4 is a view of the printing drum installed in a printing position as seen from the disengagement position side. In FIG. 4, for convenience in illustration, the rail devices 14, 16 are omitted. FIG. 5 is a view of the printing drum installed in the printing position as seen from the opposite side to that of FIG. 4. In FIG. 5, for convenience in illustration, the rail devices 14, 16 are omitted. With regard to the same constitution as that of the conventional supporting device, the same parts are indicated by the same reference numerals and description thereof is omitted. The parts that are different from the conventional supporting device shown in FIG. 7 will be mainly explained.

Between the forward side-plate 2 and the rear side-plate 4, there are disposed pipes 80, 82 as longitudinal members. The pipe 80 is fixed to the forward side-plate 2 and the rear side-plate 4 by means of welding and an end portion 80*a* of the pipe 80 is protruding outside the machine through the rear side-plate 4. The pipe 82 has the same constitution as that of the pipe 80.

Figure 6:
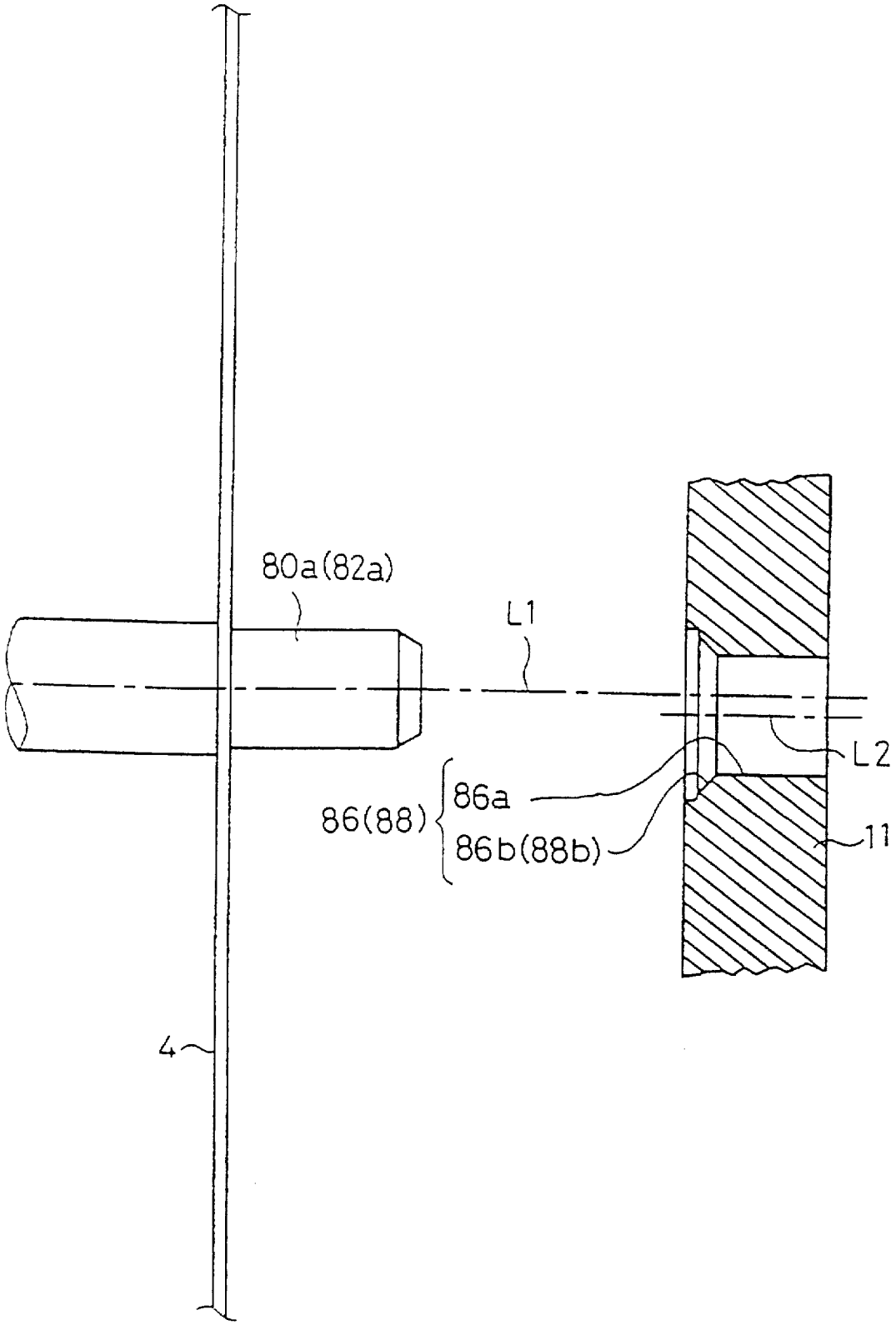
FIG. 6 is a partially sectional view illustrating fitting an end portion of a longitudinal member into a hole of a rear side-plate.

Holes 86, 88 are formed in the rear plate (rear member) 11 of the frame 13. The position of the holes 86, 88 correspond with the position of the end portions 80*a*, 82*a* of the pipes 80,82. As shown in FIG. 6, the hole 86 comprises a straight hole 86*a* and a tapered receiving portion 86*b*. The hole 88 has the same constitutions as that of the hole 86.

A supporting axis 90 supports the printing drum 6 to be rotatable in the frame 13. A leading end of the axis is formed as a tapered inserting portion 90*b*. In FIG. 3, for convenience in illustration, the supporting axis 90 is drawn in imaginary line.

The supporting axis 90 corresponds with an axis of the cylindrical printing drum, and penetrates the drum 6 from the inside to the outside. The supporting axis inside the drum is smaller in diameter than the axis outside the drum. The supporting axis inside the drum is attached to an ink supplying means (not shown).

More specifically, the printing drum 6 comprises a cylindrical circumferential wall and a pair of flanges attached to the both sides of the wall. The flanges are supported rotatably around the supporting axis 90 with bearings (not shown).

A hook (not shown in the drawing) is disposed on the inner side of the sliding rails 14*b*, 16*b* for holding the arm 12 of the frame 13. By engaging the hook with the arm 12, the frame 13 is mounted on the sliding rails 14*b*, 16*b*. When the hook is engaged with the arm, the frame 13 can not move in the drum axial direction relative to the sliding rails 14*b*, 16*b*.

An operation according to the present embodiment will be explained.

Starting from the position as shown in FIG. 3, the frame 13 is inserted into the inside of the machine along the rail devices 14, 16. As illustrated in FIGS. 4 and 5, in the forward plate 8 side of the printing drum 6, the supporting axis 90 is inserted into the hole 2*a* and the protruding portion 22 is inserted into the hole 2*b*. Further, the holes 86, 88 are respectively fitted onto the end portions 80*a*, 82*a* of the pipes 80, 82.

As illustrated in FIG.6, before the holes 86, 88 are fitted onto the end portions 80*a*, 82*a*, the axial line L2 of the holes 86, 88 is located vertically beneath the center axis line L1 of the end portions 80*a*, 82*a* at a small distance. Thus, when the end portions 80*a*, 82*a* are inserted into the holes 86, 88, the rear plate 11 of the frame 13 is raised vertically in a small distance. In this way a rear-side frameload is carried by the rear plate 11 and the pipes 80, 82. Further, the reason why the tapered receiving portion 86*b*, 88*b* are formed at front openings of the holes 86, 88 is that the end portions 80*a*, 82*a* can be fitted into the holes 86, 88 by a relatively horizontal movement in spite of the vertical height difference of their axes.

The leading end of the supporting axis 90 is also tapered. When being fitted into the hole 2*a*, the supporting axis 90 is raised vertically in a small distance, so that a load of the frame 13 in the forward plate side is carried by the supporting axis 90 and the forward side-plate.

As explained above, according to the printing drum supporting device for the stencil printing machine, the load of the frame 13 that supports the drum to be rotatable, specifically the rear side load, is stably supported by the rear plate 11 and the pipes 86, 88. Thus, the drum trembling in a direction perpendicular to the drum axis can be prevented when printing; consequently, printing quality is improved by avoiding blurs in density.

In the embodiment described above, although a printing drum of a deformable wall type is used, the present invention is not restricted to such type. For example, the present invention can be applied to a printing drum of a rigid wall type, which is disclosed in Japanese Provisional Patent Publication 8-48089. In this case a pressing roller outside the drum is driven to move toward the drum, or to depart from the same.

Further, in the embodiment described above, the forward side of the drum is supported by engaging the supporting axis 90 with the hole 2*a* in the forward side-plate 2; however, the drum forward side may be supported by another constitution. Namely, in the constitution, a protrusion resembling the supporting axis 90 is formed on the forward side-plate 2. Also a hole corresponding to the protrusion is formed on the flange (disk-like portion) of the drum 6. And then the protrusion is engaged with the hole, so that the drum forward side is supported.

According to the printing drum supporting device of the present invention, the rear side of the printing drum is firmly supported by engaging the longitudinal member protrusion with the rear plate hole of the frame. Thus, the drum trembling in a direction perpendicular to the drum axis is prevented; therefore, printing quality is improved by avoiding blurs in density.

What is claimed is:

1. A printing drum supporting device adapted to be equipped with a stencil printing machine, said printing drum supporting device comprising;

a forward side-plate and a rear side-plate disposed at a predetermined distance therebetween, a frame including a forward member and a rear member disposed at a predetermined distance therebetween, said rear member having a hole, and said frame supporting the cylindrical printing drum to be rotatable around a center axis thereof between said forward member and said rear member, a rail member disposed between the forward side-plate and the rear side-plate, said rail member supporting the frame to be detachable and guiding the frame to be movable in an axial direction of the drum between a printing position and a disengagement position, a longitudinal member fixed between the forward side-plate and the rear side-plate, and having an end portion protruding outside through the rear side-plate, so that the end portion of the longitudinal member is fitted into the hole of the rear member when the frame supporting the cylindrical printing drum is guided to the printing position.

2. A printing drum supporting device as defined in claim 1, wherein a tapered receiving portion is formed in a front opening of the hole of the rear member.

3. A printing drum supporting device as defined in claim 2, wherein an axis of the hole of the rear member is located vertically beneath an axis of the longitudinal member at a small distance when the frame supporting the cylindrical printing drum is pulled out to the disengagement position, the rear member of the frame is raised vertically in a small distance when the longitudinal member is fitted into the hole so that a load of the frame of the rear member side is carried by the rear member and the longitudinal member.

* * * * *